US005720429A

United States Patent [19]

Cordle

[11] Patent Number: 5,720,429

[45] Date of Patent: Feb. 24, 1998

[54] FOOD CONTAINER WITH FLIP-OUT CONDIMENT POCKET

[76] Inventor: Bradley D. Cordle, 306 W. 26th St., Kearney, Nebr. 68847

[21] Appl. No.: 775,953

[22] Filed: Jan. 3, 1997

[51] Int. Cl.[6] ..... B65D 5/36; B65D 5/4805

[52] U.S. Cl. ..... 229/120.18; 229/117.06; 229/405; 229/904; 229/906

[58] Field of Search ..... 229/117.05, 117.06, 229/120.18, 400, 405, 902, 904, 906

[56] References Cited

U.S. PATENT DOCUMENTS

| | | | |
|---|---|---|---|
| D. 271,942 | 12/1983 | Goldman | D9/414 |
| D. 295,133 | 4/1988 | Jones | D7/104 |
| 3,442,435 | 5/1969 | Ludder et al. . | |
| 3,468,317 | 9/1969 | Rowland . | |
| 3,561,664 | 2/1971 | Palmer . | |
| 3,567,105 | 3/1971 | McFarlin . | |
| 4,126,261 | 11/1978 | Cook . | |
| 4,489,878 | 12/1984 | Mode . | |
| 4,711,389 | 12/1987 | Alba et al. . | |
| 4,714,190 | 12/1987 | Morrocco . | |
| 4,718,595 | 1/1988 | Jones . | |
| 4,854,466 | 8/1989 | Lane, Jr. | 229/904 |
| 4,955,528 | 9/1990 | Schluckebier | 229/120 |
| 5,137,210 | 8/1992 | Hibbs | 229/120.18 |
| 5,417,364 | 5/1995 | Shaw | 229/400 |
| 5,476,215 | 12/1995 | Baroud | 229/902 |
| 5,540,333 | 7/1996 | Gonzalez et al. | 229/400 |
| 5,626,283 | 5/1997 | Mellon | 229/400 |
| 5,630,544 | 5/1997 | Shane | 229/405 |

FOREIGN PATENT DOCUMENTS

| | | | |
|---|---|---|---|
| 642389 | 10/1993 | Australia | 229/904 |
| 2068244 | 11/1993 | Canada | 229/904 |

*Primary Examiner*—Gary E. Elkins

*Attorney, Agent, or Firm*—Zarley, McKee, Thomte Voorhees & Sease; Mark D. Frederiksen

[57] ABSTRACT

The food container of the present invention includes a paperboard container with front and rear panels and collapsible side walls and collapsible bottom, permitting the container to be flattened to a nestable storage position. A flip-out pocket is operably mounted within the container, with a pocket panel having a forward edge mounted to the front panel, a rearward edge mounted to the rear panel, and a bottom edge mounted to the side wall. A central hinge extending from the top to the bottom of the pocket panel, and hinged connections of the edges of the pocket permit the pocket panel to be moved from a storage position flush against the side wall to an operable position with the upper edge spaced away from the upper edge of the side wall.

11 Claims, 2 Drawing Sheets

FOOD CONTAINER WITH FLIP-OUT CONDIMENT POCKET

TECHNICAL FIELD

The present invention relates generally to paperboard food containers, and more particularly to stackable paperboard containers formed from a blank with a flip-out condiment pocket formed thereon.

BACKGROUND OF THE INVENTION

Restaurants merchandising prepared foods, and particularly "fast food" restaurants, utilize disposable paperboard containers for various food products. Such containers have several characteristics which are required for this type of merchandising. First, the container must be able to be stacked and nested, one within another, either when partially or fully open. Second, the container must be economical to manufacture, simple to use, and be disposable after use.

It is frequently desirable to provide a condiment or sauce with the principal food product carried by the container. For example, containers of ketchup are frequently utilized with french fries, ketchup and/or mustard with hamburgers, and tartar sauce with fish or the like. The primary method for providing such condiments is in separately packaged materials, or in bulk quantities at a "condiment center".

SUMMARY OF THE INVENTION

It is therefore a general object of the present invention to provide an improved paperboard food container with a condiment pocket which may be flipped from a storage position to an operable position.

Yet another object is to provide an improved paperboard food container with flip-out condiment pocket which may be stacked or nested during shipping and storage, yet provides an easily accessible pocket for retaining condiments within the container separate from the main food product.

Still another object of the present invention is to provide an improved paperboard food container with a flip-out condiment pocket which is economical to manufacture, simple to use, and refined in appearance.

These and other objects of the present invention will be apparent to those skilled in the art.

The food container of the present invention includes a paperboard container with front and rear panels and collapsible side walls and collapsible bottom, permitting the container to be flattened to a nestable storage position. A flip-out pocket is operably mounted within the container, with a pocket panel having a forward edge mounted to the front panel, a rearward edge mounted to the rear panel, and a bottom edge mounted to the side wall. A central hinge extending from the top to the bottom of the pocket panel, and hinged connections of the edges of the pocket permit the pocket panel to be moved from a storage position flush against the side wall to an operable position with the upper edge spaced away from the upper edge of the side wall.

DESCRIPTION OF THE PREFERRED EMBODIMENT

Figure 1:
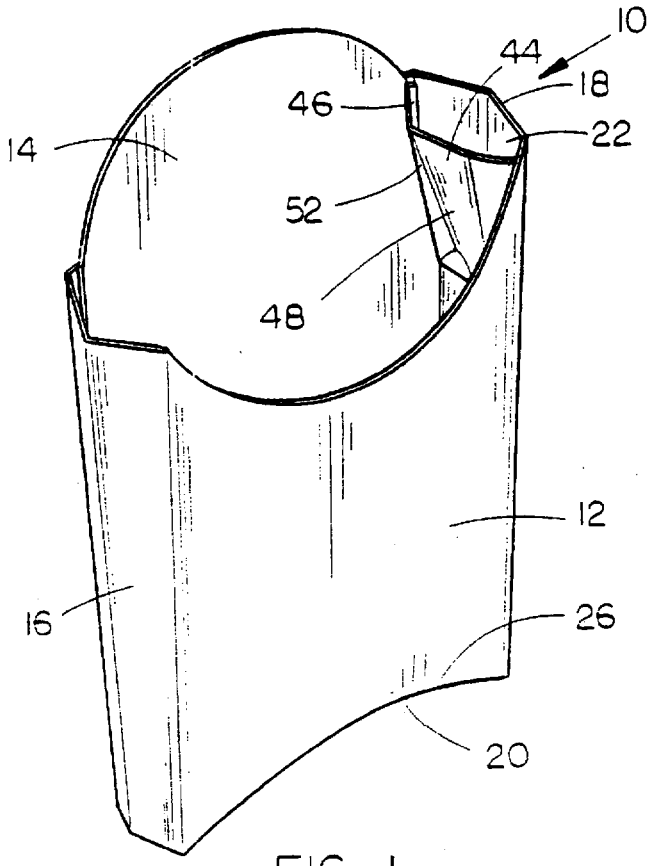
FIG. 1 is a perspective view of the invention with the flip-out pocket in the operable position.

Referring now to the drawings, in which similar or corresponding parts are identified with the same reference numeral and more particularly to FIG. 1, the paperboard container of the present invention is designated generally at 10 and includes a front panel 12, a rear panel 14, opposing folding side walls 16 and 18, a folding bottom 20, and a flip-out pocket designated generally at 22 attached to side wall 18.

Figure 7:
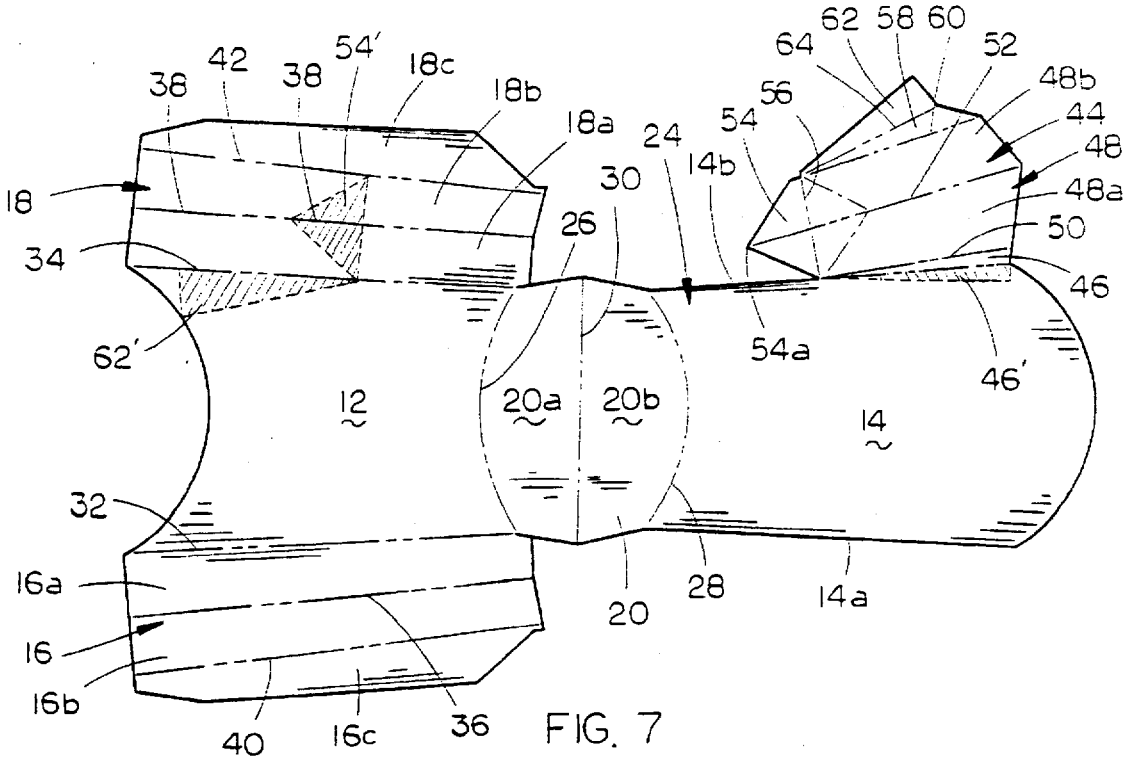
FIG. 7 is a plan view of the blank used to form the container in accordance with the invention.

Referring now to FIG. 7, a sheet of paperboard stock 24 is cut to form one piece blank 24, from which the container of the present invention is constructed. Blank 24 includes front panel 12 connected to rear panel 14 by bottom 20. Front panel 12 is hinged along a curved first fold line 26 to a forward edge of bottom 20. Similarly, the lower edge of rear panel 14 is hinged along a second fold line 28 to the opposing curved rearward edge of bottom 20. Bottom 20 is divided in half between the first and second fold lines by a third fold line 30, permitting front and rear panels 12 and 14 to be positioned closely adjacent one another in the flattened condition shown in FIG. 5, with third fold line 30 projecting downwardly and the forward and rearward halves **20*a* and 20*b* of bottom 20** located closely adjacent one another.

Figure 5:
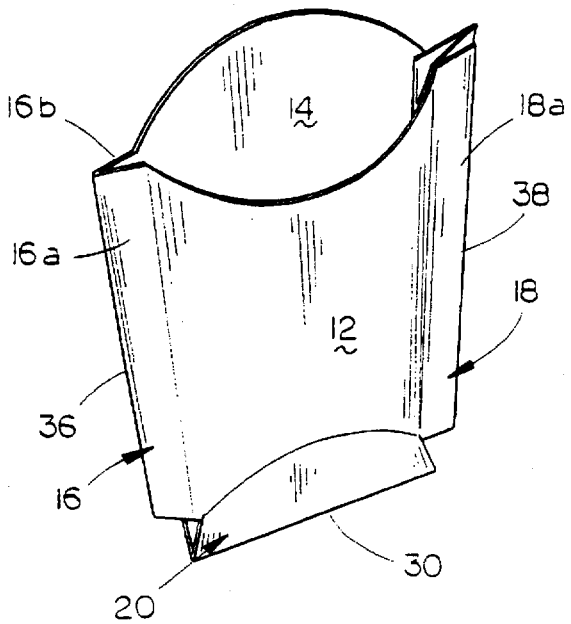
FIG. 5 is a perspective view of the paperboard container in a flattened shipping/stacking condition.

Side wall 16 is hinged along a fourth fold line 32 to one side edge of front panel 12, and extends freely therefrom. Similarly, the opposing side wall 18 is hinged along a fifth fold line 34 to the opposing side edge of front panel 12, and projects freely therefrom. Side wall 16 includes a forward half **16*a* connected to a rearward half 16*b* by a sixth fold line 36, generally parallel to fourth fold line 32. Similarly, side wall 18 includes a forward half 18*a* and rearward half 18*b* hinged at a seventh fold line 38 generally parallel to fifth fold line 34. A flap 16*c* projecting outwardly from side wall rearward half 16*b* is affixed to rear panel 14 and hinged to side wall rearward half 16*b* along eighth fold line 40. A similar flap 18*c* is hinged to side wall rearward half 18*b* along a ninth fold line 42, and is designed for attachment to rear panel 14. It should be noted that when flaps 16*c* and 18*c* are attached to rear panel 14, fold lines 40 and 42 will be juxtaposed upon the side edges 14*a* and 14*b* respectively of rear panel 14. Central fold lines 36 and 38 in side walls 16 and 18 permit the side walls to be flattened with sixth and seventh fold lines 36 and 38** projecting outwardly, as shown in FIG. 5, and the forward and rearward halves of the side walls in adjacent juxtaposition.

A pocket panel 44 projects outwardly from side edge **14*b* of rear panel 14, and is folded to form the flip-out pocket 22 (shown in FIG. 1). Pocket panel 44 includes a first triangular portion 46 hinged along side edge 14*b*. First portion 46 is folded along edge 14*b* and glued to rear panel 14 in a location shown by shaded triangular area 46'. First portion 46 forms a back wall of pocket 22. A side wall portion 48 of pocket panel 44 is hinged along a tenth fold line 50 to first portion 46. Side wall portion 48 includes a rearward trapezoidal portion 48*a* and a forward trapezoidal portion 48*b*, hinged together along the bases of the trapezoidal shape, on eleventh fold line 52. Eleventh fold line 52 is a reversible fold permitting pocket panel 44 to be moved between a storage position shown in FIG. 2 and an operable position shown in FIG. 1, by reversing the direction of the fold of fold line 52**.

Side wall portion 48 has a triangular shape bottom panel 54 forming the lower end thereof. Bottom panel 54 is folded along a twelfth fold line 56 oriented perpendicular to eleventh fold line 52, and is fastened to side wall 18 with the point 54*a* of the triangular portion of panel 54 centered on seventh fold line 38, as shown in the shaded triangular area 54'.

A triangular second portion 58 is hinged along a thirteenth fold line 60 forming the side edge of side wall portion 48. Second portion 58 forms a forward wall opposed to first portion 46. A triangular flap 62 is hinged along a fourteenth fold line 64 and is secured to front panel 12 in the triangular shaded portion 62'.

Figure 3:
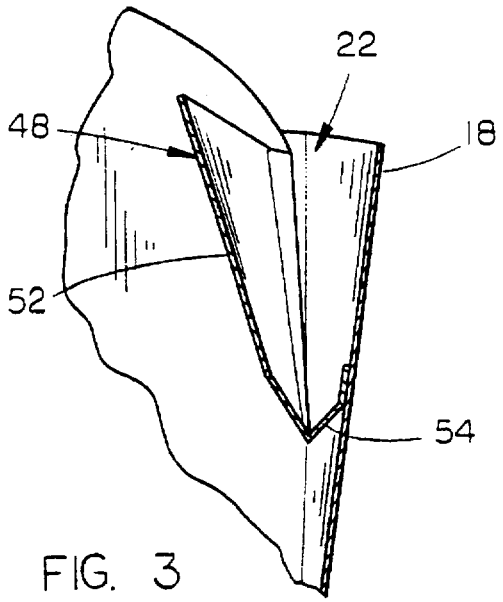
FIG. 3 is a vertical sectional view through the flip-out pocket shown in FIG. 1.

As shown in FIG. 1, pocket 22 is formed between pocket panel 44 and side wall 18, and may be flipped outwardly to form the pocket by pulling out on the upper end of side wall portion 48, away from container side wall 18. FIG. 3 shows side wall portion 48 of pocket 22 spaced outwardly away from container side wall 18, with bottom panel 54 forming the bottom of the pocket 22.

Figure 2:
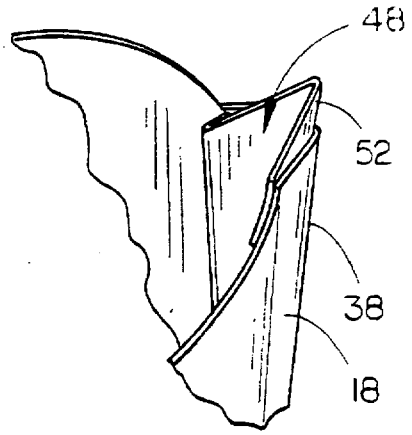
FIG. 2 is a partial perspective view of the invention with the flip-out pocket folded to the storage position.
Figure 4:
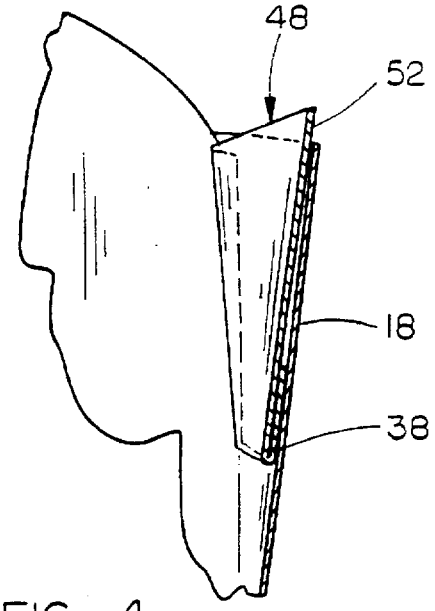
FIG. 4 is a vertical sectional view through the flip-out pocket arranged in the storage position of FIG. 2.
Figure 6:
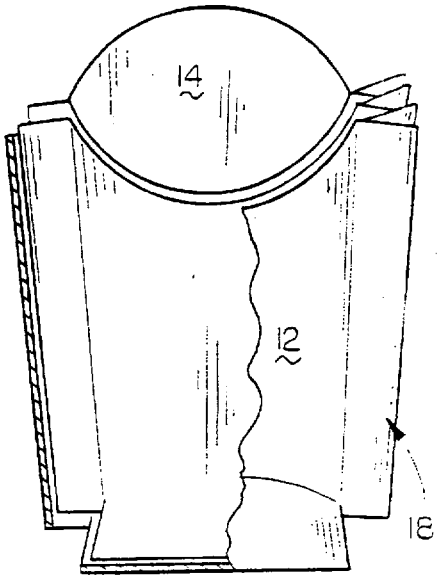
FIG. 6 is a front elevational view of a plurality of paperboard containers nested inside one another, with a portion broken away to show the nesting relationship.

Pushing outwardly along eleventh fold line 52 will cause the side wall portion 48 to reverse along fold line 52 and nest against fold line 38 of container side portion 18, as shown in FIGS. 2 and 4. In this nested storage position, a plurality of containers 10 may be nested together as shown in FIG. 6, for storage or shipment.

Whereas the paperboard container with flip-out pocket of the present invention has been shown and described herein, many modifications, substitutions and additions may be made which are within the intended broad scope of the appended claims.

I claim:

1. A food container with flip-out pocket, comprising:

a front panel spaced apart from a rear panel and connected thereto by a bottom and first and second side walls, to form a container with an open upper end; and an operable pocket formed at an upper end of the first side wall, operable between a storage position flush against the side wall, and an operable position open at an upper end to receive a condiment therein;

said pocket including a pocket panel having opposing first and second side edges and top and bottom edges;

said panel first side edge being hinged to the front panel;

said panel second side edge being hinged to the back panel;

said panel bottom edge being mounted to the first side panel;

whereby the hinges permit pivotal movement of the pocket panel from the storage position, flush against the side panel, to the operable position, with the pocket panel upper edge spaced from the side wall upper edge.

2. The container of claim 1, wherein said container and pocket panel are formed of a paperboard material, and wherein said hinges are creases in the material permitting folding along each crease.

3. The container of claim 2, wherein said first and second side walls, said bottom wall, and said pocket panel, each have means for selectively collapsing the container to a nestable flattened position with the front panel in contact with the rear panel.

4. The container of claim 3, wherein said means for selectively collapsing the container includes:

said first side wall having a forward edge hinged along a first side edge of the front panel, a rearward edge hinged along a first side edge of the rear panel, and a central hinge extending along a height of the side wall, dividing the side wall into forward and rearward halves;

said second side wall having a forward edge hinged along a second side of the front panel, a rearward edge hinged along a second side edge of the rear panel, and a central hinge extending along a height of the side wall dividing the second side wall into forward and rearward halves;

said bottom having a forward edge hinged along a lower edge of the front panel, a rearward edge hinged along a lower edge of the rear panel, and a central hinge extending a width of the bottom dividing the bottom into forward and rearward halves; and said pocket panel having a central hinge extending from the lower edge to the upper edge and dividing the pocket panel into forward and rearward halves.

5. The container of claim 4, wherein said pocket panel first side edge hinge has an upper end spaced away from an upper end of the front panel first side edge;

wherein the pocket panel first side edge hinge has a lower end juxtaposed on the front panel first side edge;

wherein the pocket panel second side edge has an upper end spaced away from an upper end of the rear panel first side edge;

wherein the pocket panel second side edge has a lower edge juxtaposed on the rear panel first side edge;

whereby the pocket panel forms a pocket with a perimeter at an upper end greater than a perimeter at a lower end thereof.

6. The container of claim 5, wherein said pocket panel includes a lower end portion folded upwardly at a fold line, the fold line oriented generally orthogonally to the pocket panel central hinge and forming a lowest end of the pocket.

7. The container of claim 1, wherein said first and second side walls, said bottom wall, and said pocket panel, each have means for selectively collapsing the container to a nestable flattened position with the front panel in contact with the rear panel.

8. The container of claim 7, wherein said means for selectively collapsing the container includes:

said first side wall having a forward edge hinged along a first side edge of the front panel, a rearward edge hinged along a first side edge of the rear panel, and a central hinge extending along a height of the side wall, dividing the side wall into forward and rearward halves;

said second side wall having a forward edge hinged along a second side of the front panel, a rearward edge hinged along a second side edge of the rear panel, and a central hinge extending along a height of the side wall dividing the second side wall into forward and rearward halves;

said bottom having a forward edge hinged along a lower edge of the front panel, a rearward edge hinged along a lower edge of the rear panel, and a central hinge extending a width of the bottom dividing the bottom into forward and rearward halves; and said pocket panel having a central hinge extending from the lower edge to the upper edge and dividing the pocket panel into forward and rearward halves.

9. The container of claim 8, wherein said pocket panel first side edge hinge has an upper end spaced away from an upper end of the front panel first side edge;

wherein the pocket panel first side edge hinge has a lower end juxtaposed on the front panel first side edge;

wherein the pocket panel second side edge has an upper end spaced away from an upper end of the rear panel first side edge;

wherein the pocket panel second side edge has a lower edge juxtaposed on the rear panel first side edge;

whereby the pocket panel forms a pocket with a perimeter at an upper end greater than a perimeter at a lower end thereof.

10. The container of claim 9, wherein said pocket panel includes a lower end portion folded upwardly at a fold line, the fold line oriented generally orthogonally to the pocket panel central hinge and forming a lowest end of the pocket.

11. The container of claim 1, wherein said pocket panel includes a lower end portion folded upwardly at a fold line, the fold line oriented generally orthogonally to the pocket panel central hinge and forming a lowest end of the pocket.

* * * * *